US006808601B1

(12) United States Patent
Lumiala

(10) Patent No.: US 6,808,601 B1
(45) Date of Patent: Oct. 26, 2004

(54) METHOD FOR MIXING DILUTION LIQUID INTO A STOCK FLOW IN A PAPER OR BOARD MACHINE TO CONTROL BASIS WEIGHT USING COARSE AND FINE CONTROLS

(75) Inventor: Juhana Lumiala, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/009,038

(22) PCT Filed: Apr. 14, 2000

(86) PCT No.: PCT/FI00/00320

§ 371 (c)(1),
(2), (4) Date: Mar. 1, 2002

(87) PCT Pub. No.: WO00/66831

PCT Pub. Date: Nov. 9, 2000

(30) Foreign Application Priority Data

Apr. 28, 1999 (FI) ..... 990967

(51) Int. Cl.[7] ..... D21F 1/02; D21F 1/08

(52) U.S. Cl. ..... 162/198; 162/208; 162/258; 162/259

(58) Field of Search ..... 162/253, 258, 162/259, 336, 344, 343, 347, 198, 61, 208

(56) References Cited

U.S. PATENT DOCUMENTS 4,897,158 A 1/1990 Weisshuhn et al.

FOREIGN PATENT DOCUMENTS

| | | | |
|---|---|---|---|
| DE | 42 39 845 | * | 5/1993 |
| DE | 196 32 673 A1 | | 2/1998 |
| DE | 197 23 861 A1 | | 12/1998 |
| EP | 0 824 157 A2 | | 7/1997 |
| FI | 901593 | | 10/1991 |
| WO | WO 00/66831 | | 11/2000 |

* cited by examiner

*Primary Examiner*—Steve Alvo
(74) *Attorney, Agent, or Firm*—Stiennon & Stiennon

(57) ABSTRACT

A method and an apparatus for mixing dilution liquid into a stock flow in a paper or board machine. Dilution is carried out in at least two stages using in the first dilution stage (I) valves ($V_1$, $V_2$, $V_3$ . . . ) fitted with a larger mutual spacing at different points of width across a headbox and passing the dilution water through the valves to desired points of width of the headbox according to the requirement of control of the basis weight of paper or board. In the second dilution stage (II), dilution water is passed into connection with the stock flow coming from the first dilution stage (I), said dilution water being controlled by means of valves ($V_1'$, $V_2'$ . . . ), which valves ($V_1'$, $V_2'$ . . . ) have been fitted with a denser spacing than the valves ($V_1$, $V_2$, $V_3$ . . . ) of the first dilution stage (I).

8 Claims, 2 Drawing Sheets

METHOD FOR MIXING DILUTION LIQUID INTO A STOCK FLOW IN A PAPER OR BOARD MACHINE TO CONTROL BASIS WEIGHT USING COARSE AND FINE CONTROLS

CROSS REFERENCES TO RELATED APPLICATIONS

This application is a U.S. national stage application of PCT Application No. PCT/FI00/00320, filed 14 Apr. 2000, and claims priority on Finnish Application No. 990967, filed Apr. 28, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method and an apparatus for mixing dilution liquid into a stock flow in a paper or board machine.

With respect to the prior art, we refer to the publications DE 19723861 and FI 901593.

It has become clear that with the development of measuring devices on the market ever higher requirements are set for the accuracy of control of the basis weight profile. Today, the dilution spacing in a so-called dilution headbox is about 32–75 mm, and it is not possible to reduce it any more if fibre-containing white water is used as dilution water, because dilution feed ducts which remain open by means of white water cannot be accommodated between tube rows with a dense spacing.

SUMMARY OF THE INVENTION

As a solution it is proposed that, when needed, dilution is changed to comprise two stages such that coarse control is carried out by means of white water and fine control is carried out by means of raw water.

The increasing requirement of control accuracy calls for an increasingly denser dilution spacing and, therefore, still narrower dilution feed ducts. If white water is used as dilution water, narrow dilution ducts clog easily. Clogging problems are not encountered with raw water, but its "full-scale use" is not economical and sensible for environmental reasons.

The idea of the two-stage dilution is to correct large basis weight profile errors by a large amount of white water and small profile errors by a small amount of raw water. A good raw water economy is achieved by this means in a paper mill. Another benefit of the two-stage arrangement is the good possibility of adjusting the basis weight profile. The entire valve control area can be made use of and control valves of an optimum size can be selected for both control operations. Coarse control is carried out in a tube bank after an inlet header, as in the conventional headbox. In the first dilution stage, the control spacing can be increased, for example, to 120 mm such that one dilution member feeds two tube rows. Course control corrects major errors in the shape of the profile, such as, for example, profile errors arising from web shrinkage. The small errors which remain in the profile after coarse control are rectified by means of fine control dilution in the second stage.

Fine adjustment is carried out as turbulence generator dilution by supplying some or each of the tubes of the turbulence generator with dilution liquid. A very small amount of dilution liquid is needed for rectifying the remaining small errors, so raw water or clarified white water obtained from a fibre recovery unit can be used economically as dilution water in fine control. Since, for example, raw water does not contain contaminating or clogging particles, the dilution ducts can be provided in very narrow spaces. Moreover, the control valves and the actuators operating the valves can be ordinary standard devices available on the market, which devices are considerably less expensive than conventional dilution valves and actuators.

Minimum local dilution with raw water can be almost 0% and maximum local dilution need not be high because the consistency of raw water is 0% and the remaining error to be corrected is small. Thus, the amount of the more expensive raw water consumed is very small. No separate circulation is required for the feed of raw water.

The price of the arrangement disclosed hardly differs at all from the price of the conventional dilution headbox. The proposed arrangement uses half the number of expensive dilution valves and actuators.

Thus, mixing units are prior known in which dilution water and stock passed from the inlet header of the headbox are mixed and the combined flow is passed further onwards in the headbox and onto a forming wire. Points of supply of dilution liquid are situated in different positions of width across the headbox and, thus, depending on the density of the dilution points placed across the width of the headbox, desired resolution is obtained for control of the basis weight of the web.

Thus, this application proposes using dilution in at least two stages. Coarse control of the basis weight profile is carried out in the first stage of dilution and fine control is carried out in the second stage of dilution. White water is used as dilution water in the first stage and the valves are arranged with a less dense spacing in the first stage than in the second control stage in which the valves are arranged with a denser spacing than in the first dilution stage. An advantage of the arrangement is that the valves of the second stage can have a construction that demands less precision and thus be less expensive than the valves of the first stage. They do not clog because fibre-free dilution water is used in the second stage. The valves can thus contain smaller ducts. They do not demand much space.

Within the scope of the invention, it is also possible to use control with three or more stages, but the most advantageous control arrangement is two-stage adjustment of the dilution liquid.

The headbox structure of the paper or board machine can advantageously be as follows:

a) stock is passed into a stock inlet header which tapers towards its outlet end in a conventional manner,
b) the stock flow is passed from the stock inlet header into a tube bank and further through the tube bank into an intermediate chamber,
c) the stock flow is passed from the intermediate chamber further into a turbulence generator and from the turbulence generator further through a slice cone onto a forming wire.

In the following, the invention will be described with reference to some advantageous embodiments of the invention shown in the figures of the accompanying drawings, to which the invention is, however, not intended to be exclusively confined.

DESCRIPTION OF THE PREFERRED EMBODIMENTS

In accordance with the invention, the valves of the first dilution stage are located in connection with the tube bank and the valves of the second dilution stage are located after the intermediate chamber in connection with the turbulence generator.

Figure 1A:
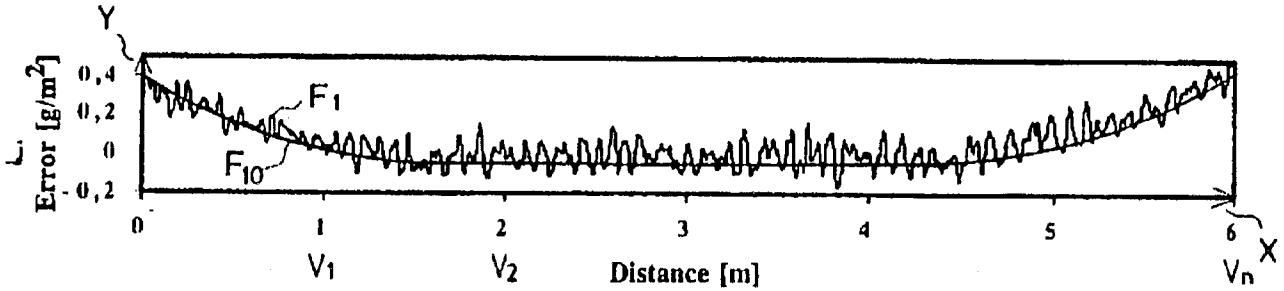
FIG. 1A is a graph showing uncorrected basis weight profile of stock passed from an inlet header $J_1$ across the width of the machine.
Figure 1B:
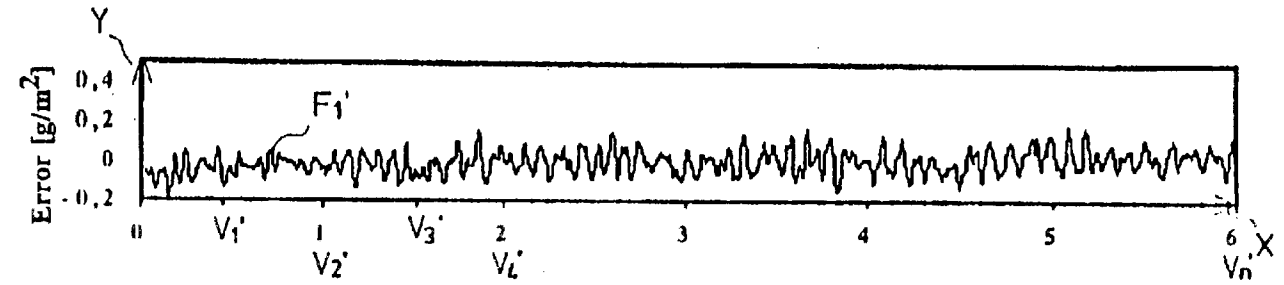
FIG. 1B is a graph showing a basis weight profile after the valves $V_1$, $V_2$ . . . controlling the basis weight profile.
Figure 1C:
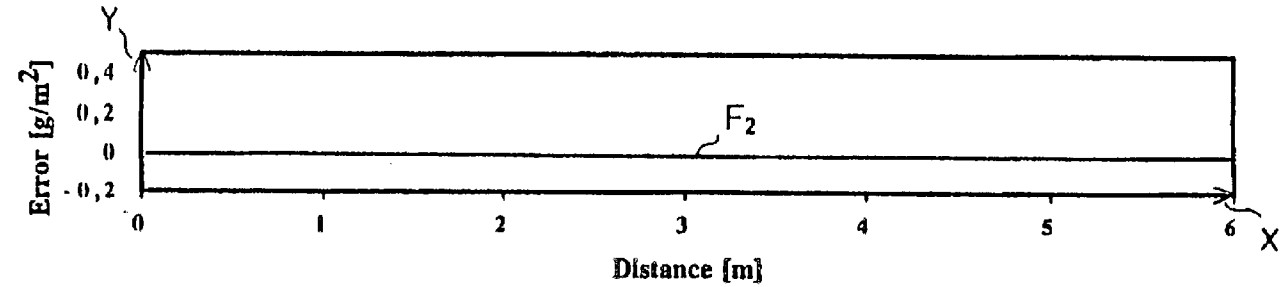
FIG. 1C is a graph showing a corrected basis weight profile of stock after the second dilution stage.

FIGS. 1A–1C show the method according to the invention in stages. The graph $F_1$ in FIG. 1A represents an uncorrected basis weight profile of stock passed from an inlet header $J_1$ across the width of the machine. In the first dilution stage, coarse control of the basis weight profile is carried out by means of valves $V_1$, $V_2$ . . . of the first dilution stage.

The graph $F_1'$ in FIG. 1B shows a basis weight profile after the valves $V_1$, $V_2$ . . . controlling the basis weight profile.

In FIG. 1C, the graph $F_2$ shows a corrected basis weight profile of stock after the second dilution stage. Dilution valves $V_1$, $V_2'$ . . . of the second dilution stage are placed, for example, in connection with a turbulence generator. The graph $F_2$ shows the basis weight profile in the stock flow across the width of the machine after adjustment carried out by the valves $V_1'$, $V_2'$ . . . of the second stage.

In FIGS. 1A–1C, the horizontal coordinate X represents headbox operation and the vertical coordinate Y represents the basis weight. A basis weight deviation from the zero level, i.e. a basis weight error, occurring in the stock and further in the web can be read from the vertical coordinate Y. The basis weight profile can be measured from the stock flow, but the easiest way to measure the basis weight is to measure it from a finished paper or board web.

Figure 2:
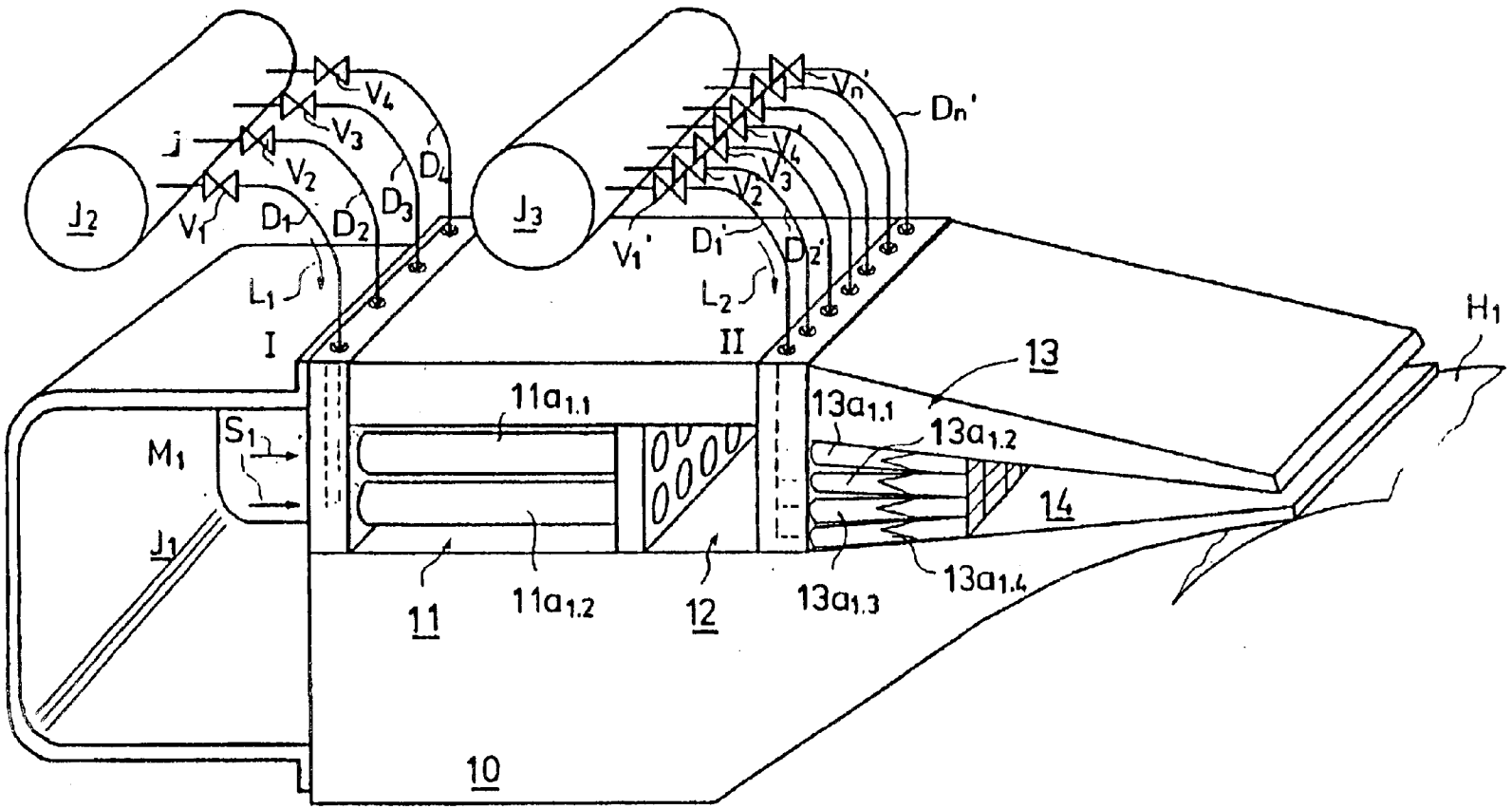
FIG. 2 shows a headbox of a paper or board machine in accordance with the invention.

FIG. 2 shows a headbox of a paper or board machine in accordance with the invention.

In FIG. 1A, the first graph $F_1$ shows control in the first dilution stage. The graph $F_1$ depicts a basis weight variation which occurs in the stock before the control valves $V_1$, $V_2$, $V_3$, of the first stage.

In FIG. 1A, the graph $F_1$ shows a basis weight variation which occurs in the stock $M_1$. An average basis weight variation is further shown by the graph $F_{10}$. As seen in the graph $F_{10}$, in the basis weight there is firstly a shape error and secondly a local error. Said shape error is corrected by means of the control valves $V_1$, $V_2$ . . . the first dilution stage I such that the graph $F_{10}$ becomes straight. The local errors are rectified by means of the control valves $V_1'$, $V_2'$ . . . in the basis weight adjustment of the second stage II.

The graph $F_1'$ of FIG. 1B illustrates the situation after the first stage, in which connection control of the basis weight of the stock $M_1$ has been accomplished by introduction of dilution liquid. In the graph, the horizontal coordinate X represents the cross-direction position of the headbox and the positions of the valves are denoted with $V_1'$, $V_2'$, $V_3'$ . . . in the horizontal coordinate X. The vertical coordinate Y shows a basis weight error of the stock after the adjustment of the first stage I. FIG. 1C shows the basis weight control of the second dilution stage II. The graph $F_2$ illustrates the situation after the dilution liquid valves $V_1'$, $V_2'$, $V_3'$ . . . of the second dilution stage. The graph $F_2$ is straight and there does not occur any basis weight error any more. In the graph, the horizontal coordinates represent the width of the headbox, and the position of the valves is denoted with $V_1'$, $V_2'$ . . . at each particular point of the horizontal coordinate X. The vertical coordinate Y shows the basis weight error of the stock. The zero level illustrates a correct constant basis weight situation. White water is used as dilution water in the first stage I, which water may contain fibres and fines/fillers. The dilution of the second stage II is carried out by means of dilution water which does not contain fibres, such as raw water. A benefit in that case is that conventional valves $V_1'$, $V_2'$, $V_3'$ . . . can be used because there is no risk of the ducts being clogged by fibres.

The dilution water feeds of the kind mentioned can be placed with a denser spacing than those of the current arrangements, the spacing between the valves in dilution control can be reduced from 60 mm to 30 mm. The amount of the dilution water used is small and there is no need for a separate circulation of the dilution water. Consequently, the construction of the arrangement according to the invention is advantageous and it allows a denser spacing to be used between the valves, i.e. higher resolution, i.e. a higher accuracy of control. By using raw water in the adjustment of the second stage it is possible to employ conventional valve arrangements, in which connection the valves can also be placed with a spacing of even 20–30 mm with respect to one another, whereas in the adjustment of the first stage, the control resolution can be changed in the case of said stage so that the valves are disposed, for example, with a spacing of 120 mm with respect to one another instead of, for example, conventional single-stage dilution of 60 mm. Thus, by using the arrangement in accordance with the invention in which the dilution of the first stage employs white water as dilution water and the dilution of the second stage employs fibre-free dilution water, an overall end result is achieved in which the accuracy of control is better than in conventional single-stage dilution and in which the construction costs with respect to structure have, however, not increased as compared with single-stage dilution.

The coarse control of the basis weight profile is carried out in the first stage of dilution and the fine control thereof is carried out in the second stage of dilution. The dilution water used in the second dilution stage is advantageously raw water or clarified white water. Thus, the dilution water of the second stage contains solids and/or fibres substantially less in percentage terms than the dilution water of the first stage, which is advantageously water taken out of the wire. Most advantageously, the dilution water of the second stage is raw water that does not contain any solids and fillers and fibres.

FIG. 2 shows a headbox 10 of a paper or board machine in accordance with the invention. The headbox comprises a stock inlet header $J_1$, a tube bank 11 after the stock inlet header, an intermediate chamber 12 after the tube bank, and a turbulence generator 13 after the intermediate chamber, and further a slice cone 14 from which stock $M_1$ is passed onto a forming wire $H_1$. In accordance with the invention, dilution of the first stage is carried out in tubes $\mathbf{11}a_{1.1}$, $\mathbf{11}a_{1.2}$, $\mathbf{11}a_{4.1}$, $\mathbf{11}a_{4.2}$ . . . of the tube bank 11 through valves $V_1$, $V_2$, $V_3$ . . . . White water is passed from a white water inlet header $J_2$ (arrow $L_1$) into tubes $D_1$, $D_2$, $D_3$ . . . and through them into the valves $V_1$, $V_2$, $V_3$ . . . and further through said adjustable valves $V_1$, $V_2$ . . . into the tubes $\mathbf{11}a_{1.1}$, $\mathbf{11}a_{1.2}$, $\mathbf{11}a_{4.1}$, $\mathbf{11}a_{4.2}$ . . . of the tube bank 11. The valves $V_1$, $V_2$, $V_3$ . . . are located, for example, with a spacing of 120 mm in connection with the headbox having a width of 10 m. The second dilution location, i.e. valves $V_1'$, $V_2'$ . . . of the second dilution stage II are advantageously located in connection with turbulence pipes 13$a_{1.1}$, 13$a_{1.2}$, 13$a_{1.3}$, 11$a_{2.1}$, 13$a_{2.2}$, 13$a_{2.3}$ of the turbulence generator 13 at different points of width across the headbox. Raw water is passed (arrow $L_2$) from a raw water inlet header $J_3$ into a duct $D_1'$, $D_2'$, $D_3'$ . . . and through the valves $V_1'$, $V_2'$ . . . further into the pipes 13$a_{1.1}$, 13$a_{1.2}$, 13$a_{1.3}$, 11$a_{2.1}$, 13$a_{2.2}$, 13$a_{2.3}$, of the turbulence generator 13, in which the raw water is passed into connection with the stock diluted in the first stage. The flow of the stock $M_1$ is denoted with the arrows $S_1$ and the flow of the dilution waters is denoted with the arrows $L_1$ and $L_2$.

When the dilution liquid is passed into connection with the stock flow in the first dilution stage and in the second stage, the dilution water is passed in the first dilution stage I either into one or more, advantageously all tubes of the tube row of the tube bank 11 at the width point in question. Similarly, in the second dilution stage II, the dilution water can be passed either into one tube of the turbulence generator 13 at the width point in question or into more tubes, advantageously into all tubes at the width point in question.

What is claimed is:

1. A method for passing dilution water into connection with a stock flow passed from a stock inlet header of a headbox in a paper or board machine, wherein dilution is carried out in at least two stages using in a first dilution stage first valves fitted with a larger mutual spacing at different points of width across the headbox and passing the dilution water through said first valves to desired points of width of the headbox according to the requirement of control of the basis weight of paper or board, and wherein in a second dilution stage (II), dilution water is passed into connection with a stock flow coming from the first dilution stage, said dilution water being controlled by means of second valves, the second valves being fitted with a denser spacing than the first valves of the first dilution stage, and that coarse control of the basis weight profile of the stock is carried out in the first dilution stage and fine control of the basis weight profile of the stock is carried out in the second dilution stage across the width of the machine.

2. The method of claim 1 wherein the dilution water used in the second stage of dilution has a solids, filler or fibre content which is substantially lower in percentage terms than that of the dilution water of the first stage of dilution.

3. The method of claim 1 wherein the dilution water used in the second dilution stage is selected from the group consisting of raw water and clarified white water.

4. The method of claim 1 wherein the dilution water of the first stage is white water.

5. A method for controlling the basis weight profile of a stock flow across the width of a papermaking machine headbox, comprising the steps of:

passing dilution water into the stock flow from a stock inlet header of the headbox, the dilution water being passed through a plurality of first valves spaced a first distance apart to points of width of the headbox to produce a first stage diluted stock flow in which coarse control of the basis weight profile of the stock is carried out; and passing dilution water into the first stage diluted stock flow through a plurality of second valves, the second valves being spaced apart a second distance which is less than the first distance to produce a second stage diluted stock flow in which fine control of the basis weight profile of the stock is carried out across the width of the machine.

6. The method of claim 5 wherein the dilution water used in the second stage of dilution has a solids, filler or fibre content which is substantially lower in percentage terms than that of the dilution water of the first stage of dilution.

7. The method of claim 5 wherein the dilution water used in the second dilution stage is selected from the group consisting of raw water and clarified white water.

8. The method of claim 5 wherein the dilution water of the first stage is white water.

* * * * *